United States Patent [19]

Gutridge et al.

[11] 4,155,145

[45] May 22, 1979

[54] DOOR LIFTER CONSTRUCTION

[75] Inventors: Jack E. Gutridge, Dyer; Eugene I. Varda, Saint John, both of Ind.

[73] Assignee: Pullman Incorporated, Chicago, Ill.

[21] Appl. No.: 899,142

[22] Filed: Apr. 24, 1978

[51] Int. Cl.[2] ..... A47H 33/02

[52] U.S. Cl. ..... 16/99; 49/235

[58] Field of Search ..... 16/99, 97, 102, 103; 49/425, 426, 235

[56] References Cited

U.S. PATENT DOCUMENTS

| | | | |
|---|---|---|---|
| 2,299,297 | 10/1942 | Beauchamp | 16/99 |
| 2,335,397 | 11/1943 | Ditchfield | 16/99 |
| 2,682,075 | 6/1954 | Dietrichson | 16/99 |
| 3,998,801 | 11/1976 | Hutchison | 16/99 |
| 4,112,540 | 9/1978 | Wright et al. | 16/99 |

*Primary Examiner*—George H. Krizmanich

*Attorney, Agent, or Firm*—Thomas G. Anderson

[57] ABSTRACT

A door lifter mechanism for a railway car door is operable by a handle which acts on two fulcrum bars. A fulcrum bar lifter roller is carried by the handle and supports the ends of the fulcrum bars, which are joined by a pivot spool received in slots in the fulcrum bars.

9 Claims, 12 Drawing Figures

50
42
48
38
54
32
92
28
56
48
34
10
46
52
8
54
68
8

7
3
42
7
6
38
6
34
26
30
18
5
32
5
28
3
36
40
44

DOOR LIFTER CONSTRUCTION

BACKGROUND OF THE INVENTION

1. Field of the Invention

The present invention relates to door lifter constructions for railway cars in which an operating handle lowers rollers on a guide rail so the door can be slid to one side.

2. Description of the Prior Art

The prior art, as exemplified by U.S. Pat. Nos. 2,225,679, 2,258,713, 2,263,468 2,286,974, 2,373,447, 2,427,566 and 2,682,075 is generally cognizant of door lifter mechanisms for raising railway doors by lowering rollers on a guide rail by using a handle to act on long lever arms.

SUMMARY OF THE INVENTION

The present invention is summarized in that a door lifter construction for a railway car adapted to rolling on a guide rail includes a handle pivotally secured to the door, a fulcrum bar lifter roller rotatably carried on the handle below its pivot point, a pair of fulcrum bars pivotally secured to the door, a door lifter roller carried at one end of each fulcrum bar and adapted to engage the guide rail when the fulcrum bar is pivoted, a lifter end on the end of each fulcrum bar opposite from the door lifter roller and each lifter and having an elongated slot defined therethrough, and a pivotal spool received in the slots in each of the lifter ends; the pivotal spool being movable within the slots so that it remains centered in the slots as the fulcrum bar lifter is pivoted about its pivot point and the fulcrum bar lifter roller rolls along the sloped surface of the fulcrum bar, thus forcing the fulcrum bar up. The fulcrum bar in its movement upward also carries with it the opposite fulcrum bar, and thus both fulcrum bars are raised simultaneously forcing the door lifter roller down to the guide rail.

It is an object of the present invention to construct a door lifter construction that operates with a minimum amount of friction and ease and maximum eveness.

It is another object of the invention to construct a door lifter construction having a pair of bars carrying rollers wherein the mechanism contacting the fulcrum bars rolls freely to maintain continuous contact with said one fulcrum bars.

It is yet another object of the present invention to provide a door lifter construction wherein the components subject to the most wear are easily replacable.

Still more objects, advantages and features of the present invention will become apparent from the following description when taken in conjunction with the accompanying drawings.

DESCRIPTION OF THE PREFERRED EMBODIMENT

Figure 1:
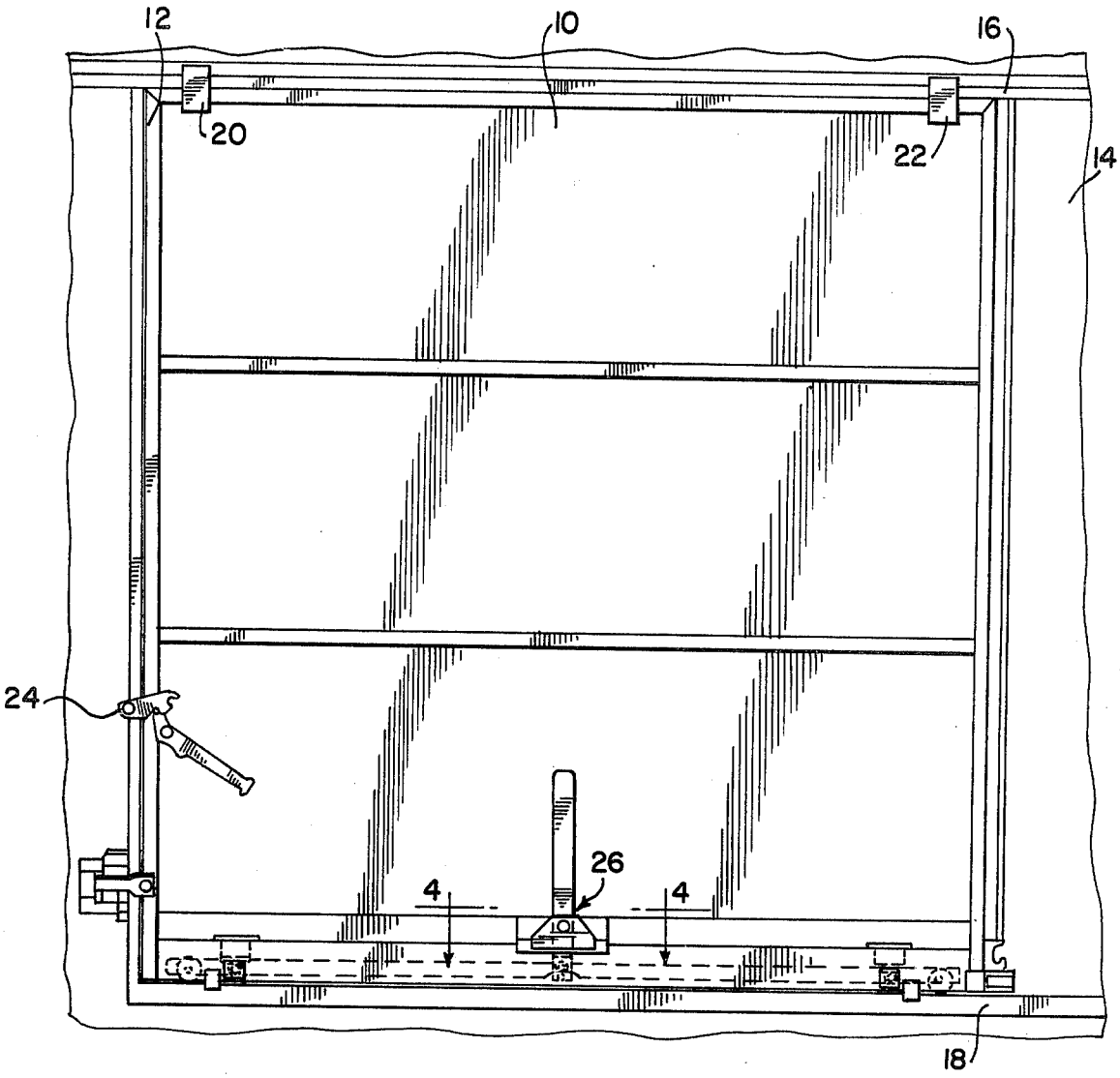
FIG. 1 is a side elevation view of a railway car door including the door lifter construction of the present invention.

Shown in FIG. 1 is a sliding door 10, for use in a railway car, constructed in accordance with the present invention. The door 10 covers an opening 12 in a side 14 of the railway car and slides on upper and lower guide rails 16 and 18. Conventional guide members 20 and 22 are provided at the top of the door 10 to guide the top of the door 10 along the upper guide rail 16. A latching mechanism 24 is provided to latch the door 10 in place at the position where it seals the opening 12 in the side 14 of the car completely. At the bottom of the door 10 is provided a door lifter construction, indicated generally at 26.

Figures 2, 3, 8:
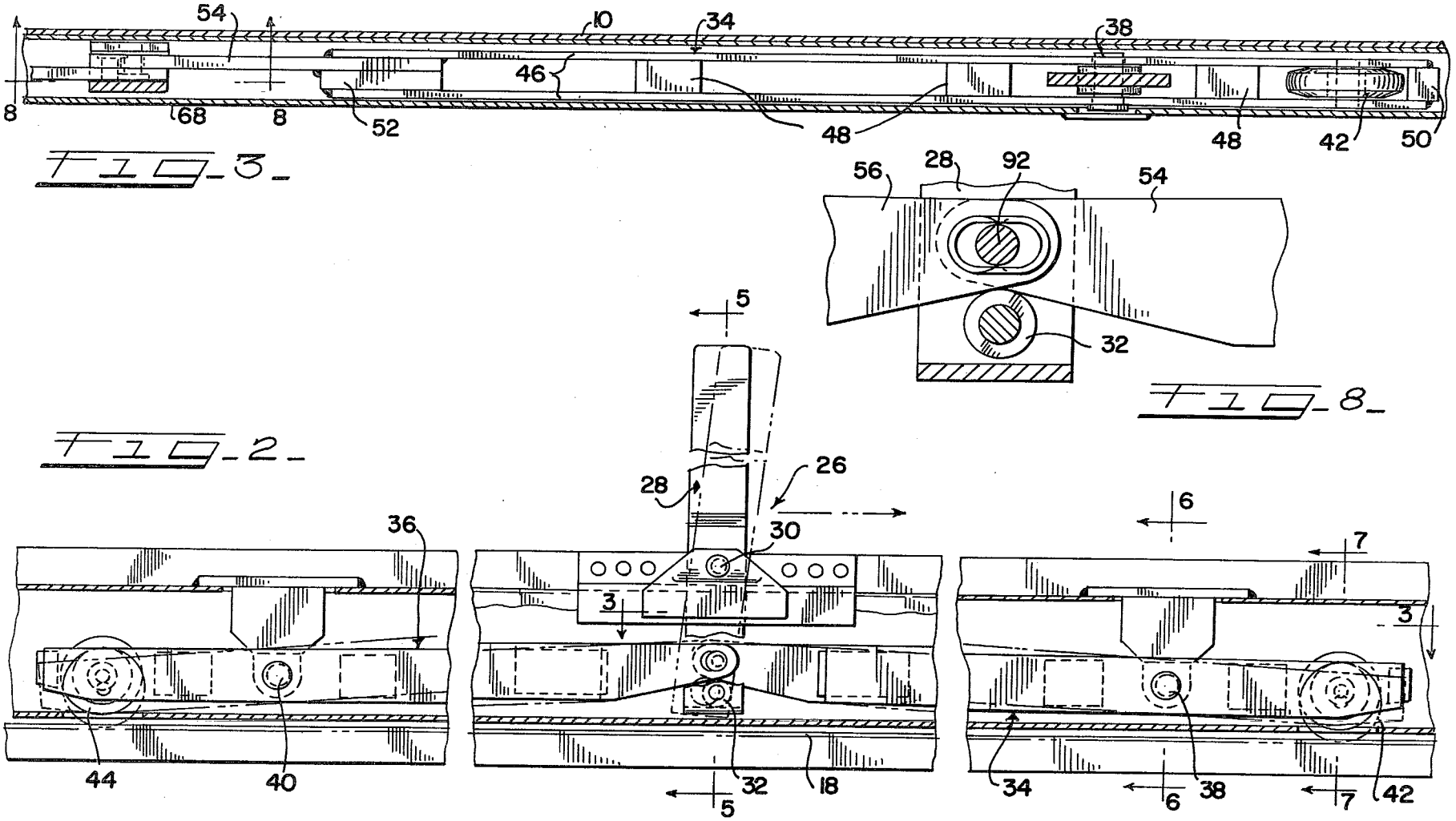
FIG. 2 is a enlarged view of the door lifter construction of FIG. 1.
FIG. 3 is a sectional view along line 3—3 of FIG. 2.
FIG. 8 is an enlarged view of the lower end of the handle of FIG. 2 in its inoperative position.

As is shown in FIG. 2, the door lifter construction 26 includes a handle, generally indicated at 28, which is pivoted at a handle pivot pin 30 and which carries near its lower end a fulcrum bar lifter roller 32. The fulcrum bar lifter roller 32 has resting on its one end of each fulcrum bar, generally indicated at 34 and 36. The fulcrum bars 34 and 36 are in turn pivoted at respective fulcrum bar pivot pins 38 and 40 and carry near their other ends respective door lifter rollers 42 and 44.

Figures 9, 10, 11, 12:
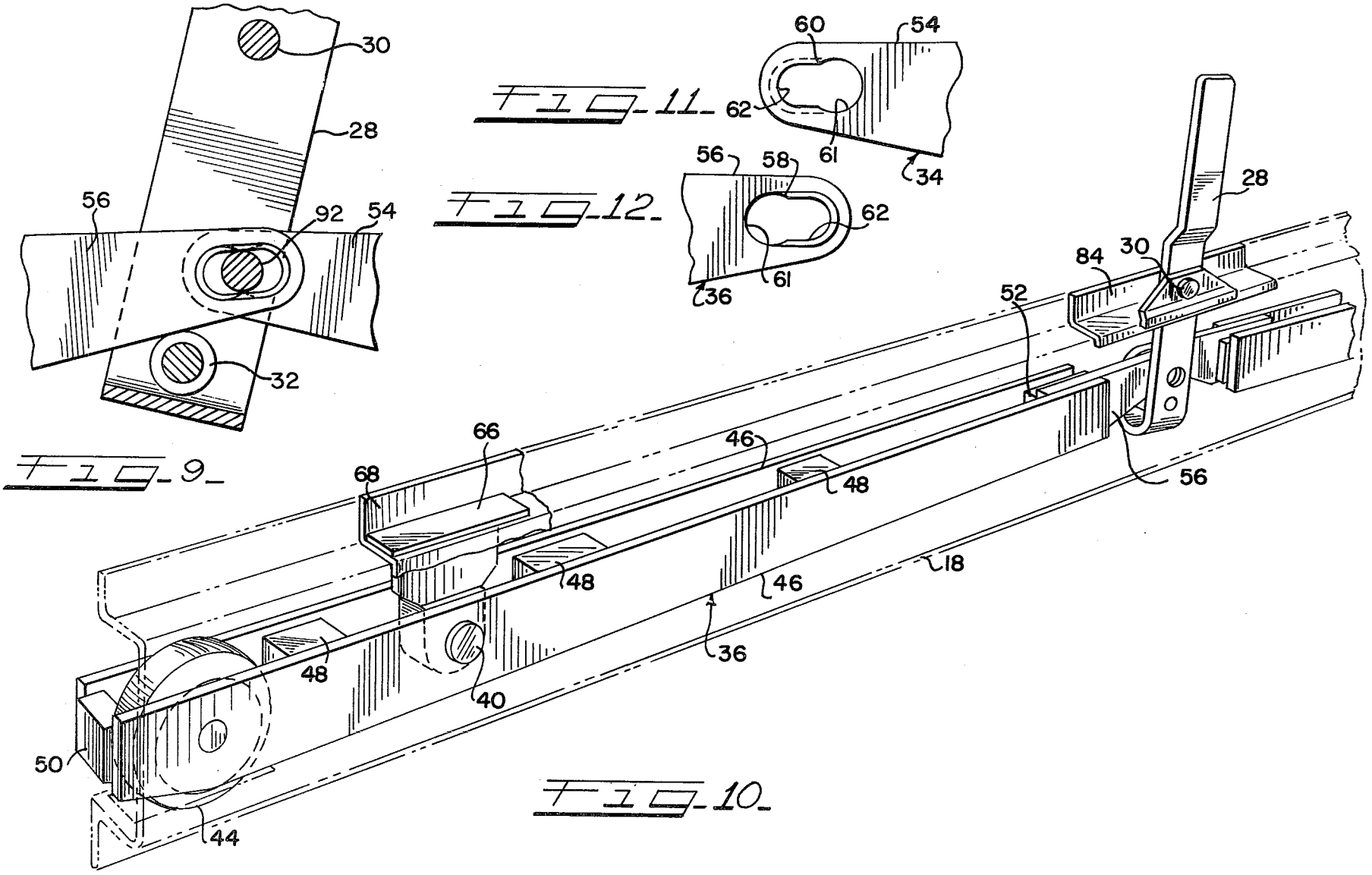
FIG. 9 is an enlarged view of the lower end of the handle of FIG. 2 in its operative position.
FIG. 10 is a perspective view of a fulcrum bar of FIG. 2.
FIG. 11 is an enlarged view of the end of one of the fulcrum bars of FIG. 2.
FIG. 12 is an enlarged view of the end of the other of the fulcrum bars of FIG. 2.

Shown in FIGS. 3 and 10 are the details of construction of the fulcrum bars 34 and 36. Each of the fulcrum bars 34 and 36 is formed for most of its length of a pair of twin fulcrum beams 46 which have welded between them a series of spacers 48 and have inserted between them at their extreme end adjacent the door lifter rollers 42 and 44 an end insert 50. Also welded between the other ends of the twin fulcrum beams 46 in each of the fulcrum bars 34 and 36 is a lifter end spacer 52 and a respective lifter end 54 an 56. The lifter ends 54 and 56 each has provided therein a respective pivot spool slot 58 and 60, as is shown in FIGS. 11 and 12. Each of the pivot spool slots 58 and 60 is elongated along the axis of the fulcrum bars 34 and 36 and includes an enlarged portion 61 and a narrower counterbored portion 62.

Figure 6:
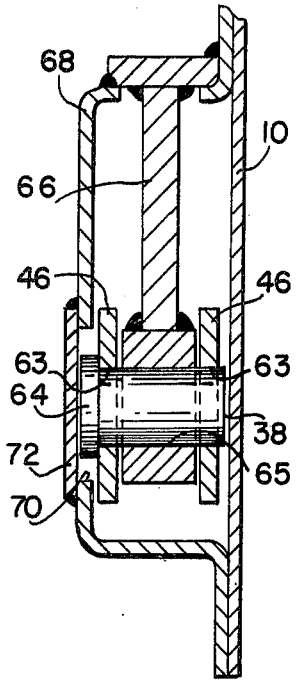
FIG. 6 is a sectional view along line 6—6 of FIG. 2.

As shown best in FIG. 6, the fulcrum bar pivot pin 38 is received through a hole 63 formed in each of the respective twin fulcrum beams 46 of the fulcrum bar 34. The fulcrum bar pivot pin 38, which has an enlarged head 64 at one end thereof, also extends through a bore 65 in the lower end of a support plate 66, which lower end is disposed between the twin fulcrum beams 46. The upper end of the support plate 66 is welded to a fulcrum bar cover plate 68 which is attached in turn to the door 10. The fulcrum bar cover plate 68 extends around and covers the fulcrum bar 34, and has an opening 70 formed therein so as to accommodate the enlarged head 64 of the fulcrum bar pivot pin 38, and opening 70 being covered by a retaining cover plate 72 tackwelded to the fulcrum bar cover plate 68.

Figure 7:
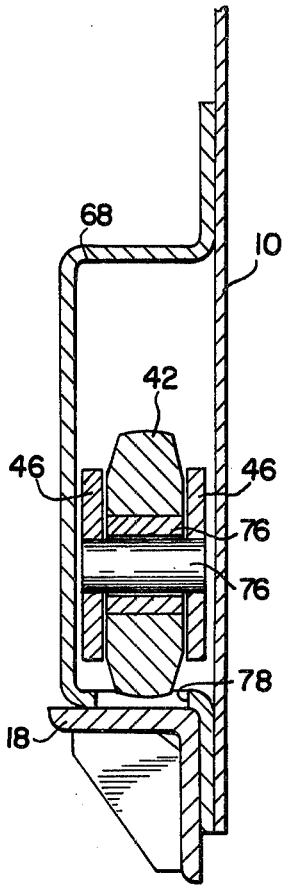
FIG. 7 is a sectional view along line 7—7 of FIG. 2.

As shown best in FIG. 7, the door lifter roller 42 is also disposed between the twin fulcrum beams 46 which are within the fulcrum bar cover plate 68. A shaft 74 is attached to both the twin fulcrum beams 46 and extends through a bearing 76 upon which the door lifter roller 42 is mounted. A roller opening 78 is provided in the fulcrum bar cover plate 68 beneath the door lifter roller 42. When the door lifter construction 26 is not engaged, the fulcrum bar cover plate 68 rests directly in the lower guide rail 18, as is shown in FIG. 7, the lower guide rail 18 being secured to the side 14 of the railway car.

The structure of both the fulcrum bar pivot pin 40 and the door lifter roller 44 and their associated components is understood to be similar to that of the fulcrum bar pivot pin 38 and the door lifter roller 42, which have been more fully described above.

Figure 4:
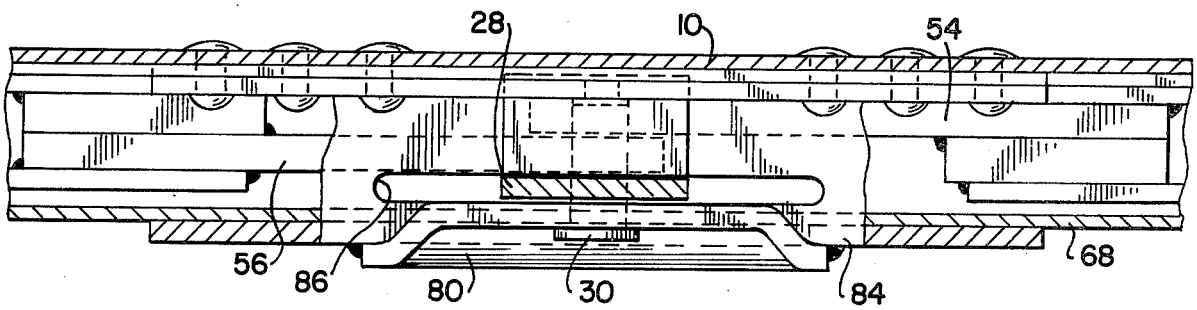
FIG. 4 is a sectional view along line 4—4 of FIG. 1.
Figure 5:
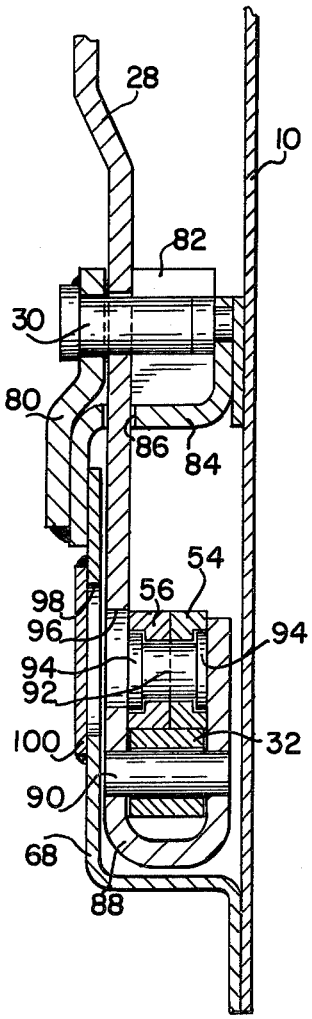
FIG. 5 is a sectional view along line 5—5 of FIG. 2.

The details of the construction of the handle 28 and the fulcrum bar lifter roller 42 are shown best in FIG. 5. The handle pivot pin 30 extends, in order, through a pivot plate 80, the handle 28, a pivot block 82 and into a cover bracket 84 secured to the fulcrum bar cover plate 68. The handle pivot pin 30 is fixed to the pivot plate 80, the pivot block 82 and the cover bracket 84, but the handle 28 pivots freely about it. The handle 28 extends through a handle slot 86 in the cover bracket 84, as is best seen in FIG. 4. The lower end of the handle 28 is bent into a U-shaped section 88. A roller shaft 90 extends through and is secured to both legs of the U-shaped section 88. The fulcrum bar lifter roller 32 is mounted in the roller shaft 90 so that it is freely rotatable thereupon. The lifter ends 54 and 56 of the fulcrum bars 34 and 36 rest on the fulcrum bar lifter roller 32 so that the pivot spool slots 58 and 60 are aligned. Inserted into the pivot spool slots and holding the lifter ends 54 and 56 together is a pivot spool 92. The pivot spool 92 is shaped with an enlarged rim 94 provided at each of its ends of a size so as to fit into the counterbore portions 62 of the pivot spool slots 58 and 60, as shown in FIG. 5. Access openings 96 and 98 are provided respectively in the handle 28 and in the fulcrum bar cover plate 68, the access openings being covered by an access opening cover plate 100 tack-welded to the fulcrum bar cover plate.

In the operation of the door lifter construction 28, the door 10 is lifted by the operation of the handle 28. Normally the handle 28 rests in a vertical position as shown in FIG. 1 and by the unbroken line in FIG. 2. By forcing the upper end of the handle 28 to one side, as shown by the broken line in FIG. 2, the handle 28 is pivoted about the handle pivot pin 30 and the fulcrum bar lifter roller 32 moves to one side and upward thereby lifting the lifter ends 54 and 56 of the fulcrum bars 34 and 36, causing the fulcrum bars 34 and 36 to pivot about their fulcrum pivot pins 38 and 40. This lowers the door lifter rollers 42 and 44 into the roller openings 78 in the fulcrum bar cover plate 68 until the rollers abut the lower guide rail 18. Further pressure on the handle 28 causes the door 10 to be lifted up as the fulcrum bars 34 and 36 pivot further forcing the door lifter rollers 42 and 44 downward and inward against the lower guide rail 18. Once the fulcrum bar cover plate 68 and thereby the door 10 is lifted off the lower guide rail 18, the door 10 can easily be rolled to one side to expose the opening 12. Release of the handle 28 allows the weight of the door 10 to force the door lifter rollers 42 and 44 back into the fulcrum bar cover plate 68 pivoting the fulcrum bars 34 and 36 to their original positions and returning the handle 28 to its vertical orientation.

The specific action of the fulcrum bar lifter roller 32 is best shown in FIGS. 8 and 9, showing the handle 28 in its vertical position and FIG. 9 showing the handle after its upper end has been pushed to one side to operate the door lifter. In FIG. 8, the lifter ends 54 and 56 of the fulcrum bars 34 and 36 are lying in a generally horizontal orientation with the pivot spool 92 resting at a midway point in each of the pivot spool slots 58 and 60. When the handle 28 is pivoted, the fulcrum bar lifter roller 32 moves to one side and upward, as is shown in FIG. 9, rolling as it goes against the edges of the lifter ends 54 and 56. The junction point between the fulcrum bars 34 and 36 moves vertically while the fulcrum lifter roller moves laterally in an arc-wise direction forcing a fulcrum bar 34 or 36 up and pivoting about pivot pin 38. The fulcrum bars 34 and 36 being pinned together at a junction with pivot spool 92 forcing both bars to raise simultaneously as shown in FIG. 9. This construction assures that the weight of the door 10 is always evenly distributed between the door lifter rollers 42 and 44 and that the mechanism operates with the least possible friction. Since the fulcrum bars 34 and 36 have their lifter ends 54 and 56 raised to approximately the same height, which is assured since they are pinned together by the pivot spool 92, the door lifter rollers 42 and 44 will be lowered the same distance relative to the door 10 so that each carries approximately equal weight. Thus, smooth, frictionless and even operation is assured by the combination of the fulcrum bar lifter roller 32 and the pivot spool 92. The fulcrum bar lifter roller 32 rotates freely about the roller shaft 90 so that the friction between the lifter ends 54 and 56 and the actuating handle is minimized.

The present construction also allows for easy replacement of the critical parts subject to the most wear, in particular the pivot spool 92 and the fulcrum bar pivot pins 38 and 40. To replace the pivot spool 92, the access opening cover plate 100 is removed and access is made to the pivot spool through the access openings 96 and 98. The retaining cover plate 72 is removed from opening 70 and the fulcrum bar pivot pin 38 is removed. The fulcrum bar 34 is moved laterally until the enlarged holes 61 in 54 and 56 are in line; then the pivot spool 92 may be removed. A new pivot spool is then reinserted in a similar manner whereafter the pivot pin 38 is replaced and the retaining cover plate 72 and the access opening cover plate 100 tack-welded in place.

Inasmuch as the above described invention is subject to many modifications, variations and changes in detail, it is intended that the aforegoing specification and accompanying drawings be interpreted in an illustrative rather than a limiting sense.

What is claimed is:

1. A door lifter construction for a railway car door slidable along a guide rail comprising:

a handle pivotally secured to the door, a fulcrum bar lifter roller rotatably carried in the handle below its pivot point, a pair of fulcrum bars pivotally secured to the door, a door lifter roller carried at one end of each fulcrum bar and adapted to engage the guide rail when the fulcrum bar is pivoted, a lifter end on the end of each fulcrum bar opposite from the door lifter roller, the lifter ends resting on the fulcrum bar lifter roller and each lifter end having an elongated slot defined therethrough, and a pivot spool received in the slots in each of the lifter ends, the pivot spool being movable within the slots so that it moves to follow the lateral movement of the fulcrum bar lifter roller so as to maintain contact between the rotating fulcrum bar lifter roller and both of the lifter ends as the handle and the fulcrum bars are pivoted.

2. A door lifter construction as claimed in claim 1 wherein, the handle includes a U-shaped section with two legs and the fulcrum bar lifter roller is carried in the U-shaped section so that the lifter ends rest between the legs of the U-shaped section.

3. A door lifter construction as claimed in claim 2, wherein a roller shaft extends between the legs of the U-shaped section, the fulcrum bar lifter roller being carried on the roller shaft.

4. A door lifter construction as claimed in claim 1, wherein the pivot spool has an enlarged rim at each end thereof.

5. A door lifter construction as claimed in claim 4, wherein each slot includes an enlarged portion and a smaller counterbored portion, with the enlarged portion being large enough for the rims of the pivot spool to pass therethrough, the counterbored portion sized to prevent the enlarged rims of the pivot spool from passing therethrough.

6. In a door lifter for a railway car door slidable along a guide rail, the combination comprising;

a handle pivotally secured to the door, a U-shaped section at the bottom of the handle, a freely rotatable fulcrum bar lifter roller carried in the U-shaped section of the handle, a pair of fulcrum bars pivotally secured to the door, a door lifter roller carried by each fulcrum bar at one extreme end thereof, a lifter end at one end of each fulcrum bar opposite the door lifter roller, the lifter ends resting on the fulcrum bar lifter roller, each of the lifter ends having defined therein an elongated slot, each slot having an enlarged portion, a fulcrum bar over plate attached to the door and extending around the fulcrum bar and the U-shaped section of the handle, a fulcrum bar cover plate and the U-shaped section of the handle each having defined therein an access opening adjacent the slots in the lifter ends, an access opening cover plate attached to the fulcrum bar cover plate and covering the access openings, and a pivot spool having two enlarged rims and received in the slots in both of the lifter ends, the pivot spool being replacable by removing the access opening cover plate and manipulating the enlarged rims of the pivot spool through the enlarged portions of the slots.

7. The combination as claimed in claim 6, wherein the fulcrum bar cover plate has roller openings defined therein beneath each of the door lift rollers to allow movement of the door lifter rollers therethrough.

8. The combination as claimed in claim 6, wherein a pivot pin extends through the fulcrum bars, and wherein a support plate fixed to the fulcrum bar cover plate slidably receives each of the pivot pins therethrough, to pivotally secure the fulcrum bars to the door.

9. The combination as claimed in claim 8, wherein there is an opening defined in the fulcrum bar cover plate adjacent each of the pivot pins, and a retaining cover plate covering each of the openings in the fulcrum bar cover plate, the retaining cover plate retaining the pivot pins extending through the support plates and the fulcrum bars in place.

* * * * *